United States Patent [19]

Hatanaka et al.

[11] Patent Number: 4,874,923

[45] Date of Patent: Oct. 17, 1989

[54] GLOW PLUG FOR DIESEL ENGINE WITH A U-SHAPED SIALON CERAMIC HEATER

[75] Inventors: Koji Hatanaka; Kenzi Maruta; Hirohisa Suwabe, all of Saitama, Japan

[73] Assignees: Jidosha Kiki Co., Ltd.; Hitachi Metals, Ltd., both of Tokyo, Japan

[21] Appl. No.: 346,382

[22] Filed: Apr. 28, 1989

Related U.S. Application Data

[63] Continuation of Ser. No. 170,673, Mar. 18, 1988, abandoned, which is a continuation of Ser. No. 3,494, Jan. 15, 1987, abandoned.

[30] Foreign Application Priority Data

Jan. 22, 1986 [JP] Japan ..... 61-9933

[51] Int. Cl.[4] ..... F23Q 7/22; F02P 19/00; H05B 3/00; H01C 1/14

[52] U.S. Cl. ..... 219/270; 123/145 A; 219/541; 219/553; 338/326; 361/266

[58] Field of Search ..... 219/270, 552, 553, 541, 219/260–269; 123/145 R, 145 A; 338/326; 373/134; 361/264–266

[56] References Cited

U.S. PATENT DOCUMENTS 4,401,065 8/1983 Minegishi et al. ..... 123/145 A
4,475,029 10/1984 Yoshida et al. ..... 219/270
4,652,727 3/1987 Hoshizaki et al. ..... 219/541
4,653,443 3/1987 Fukazawa et al. ..... 123/145 A

FOREIGN PATENT DOCUMENTS 57-199759 12/1982 Japan ..... 219/270
58-62427 4/1983 Japan ..... 219/270
60-9085 1/1985 Japan .
60-14784 1/1985 Japan .

*Primary Examiner*—Anthony Bartis
*Attorney, Agent, or Firm*—Blakely, Sokoloff, Taylor & Zafman

[57] ABSTRACT

A glow plug for a diesel engine includes a U-shaped ceramic heater of SIALON supported by a hollow metallic holder. The heater has a U-shaped heating portion projecting from one end of the holder and is supported therein by a pair of parallel ceramic lead portions of a thicknesses greater than the heating portion. One lead portion is electrically connected to the interior of the holder and the other lead portion is electrically insulated from the holder and electrically connected to an external connecting terminal extending into the other end of the holder. The lead portions are spaced from each other to define a slit therebetween open to the interior of the holder. A sintered ceramic sheet of SIALON integrally seals the slit against entry of combustion gases into the interior of the holder.

6 Claims, 4 Drawing Sheets

GLOW PLUG FOR DIESEL ENGINE WITH A U-SHAPED SIALON CERAMIC HEATER

This is a continuation of application Ser. No. 170,673, filed Mar. 18, 1988, now abandoned, which in turn is a continuation of application Ser. No. 003,494, filed Jan. 15, 1987, and now abandoned.

BACKGROUND OF THE INVENTION

The present invention relates to a glow plug used for preheating a sub combustion chamber or a combustion chamber of a diesel engine and, more particularly, to a glow plug for a diesel engine, which is of a fast heat type and has improved heating characteristics and self-temperature saturability to obtain a long after glow time.

Generally, since a diesel engine has a poor startability at a low temperature, a glow plug is installed in a sub combustion chamber or in a combustion chamber, and current flows through it to generate heat. Thus, the glow plug increases an intake air temperature or is used as an ignition source, thereby improving startability of the engine. A typical conventional glow plug of this type is of sheath type obtained by charging a heat-resistant insulating powder in a metal sheath and burying a coil heating wire made of iron, chromium, nickel, or the like therein. However, as shown in Japanese Patent Prepublication (Kokai) No. 57-41523 and the like, a ceramic type glow plug using a rod heater obtained by burying a heating wire made of, e.g., tungsten, in an insulating ceramic material such as silicon nitride is also known. As compared to the sheath type glow plug utilizing indirect heating through a heat-resistant insulating powder and a sheath, the latter, i.e., the ceramic heater type glow plug is superior in terms of heat transfer efficiency and heating characteristics, can be heated to red hot in a short time during heating to greatly improve temperature rise characteristics, can achieve performance as a fast heat type, and therefore is widely used in recent years.

However, the conventional ceramic heater type glow plug described above has a structure obtained by burying a heating wire made of a metal (tungsten) inside an insulating ceramic material such as silicon nitride. Since coefficients of thermal expansion of these two materials are different from each other, a problem, such as cracking, may be posed especially during heating due to rapid increase in temperature and repeated operations, resulting in poor durability, poor reliability such as heat resistance, and high cost of the ceramic heater.

In order to eliminate the above problems, Japanese Patent Prepublication (Kokai) Nos. 60-9085 and 60-14784 propose ceramic heater structures in which a heating wire is formed by a conductive ceramic material having substantially the same coefficient of thermal expansion as that of the insulating ceramic material. However, neither of them can be used as a glow plug in practice because of their structural and functional problems.

For example, the former is obtained by burying a conductive ceramic material serving as a heating body into an insulating ceramic material. Therefore, although it is superior to the sheath type in terms of thermal conductivity, it cannot serve as a fast heat type glow plug because of indirect heating, and fabrication thereof is cumbersome and complex. On the other hand, the latter can function as a fast heat type because a heating body is exposed at the side of the heater surface. However, since the heating body is simply formed by a stacking structure of members to obtain a U-shape and both ends thereof are merely connected to the rear end of the heater, the electrode structure becomes complex, resulting in high cost.

Furthermore, in the conventional ceramic heater type glow plugs, the heating section is formed by a junction structure of a conductive ceramic material and an insulating ceramic material. Therefore, although their coefficients of thermal expansion are substantially the same, their reliability is poor as a ceramic heater in a glow plug whose heating temperature is 1,100° C. at maximum.

In addition, in the glow plug of this type, a demand for adopting a so-called after glow method is great in the market in recent years. In this method, durability against high temperatures of operating conditions is high due to improvements in startability of a diesel engine and adoption of turbo system. The glow plug is kept energized for a predetermined time interval after the engine is started to smoothly perform combustion inside the engine, so that exhaust and noise countermeasures are obtained. Furthermore, this after glow time must be as long as possible (e.g., 10 minutes). In order to achieve such a long after glow time, energization power must be self-controlled to greatly improve heating characteristics and prevent over heat at the heater, and a self temperature saturation function must be provided to maintain a saturation temperature below a proper temperature. Thus, a glow plug having a ceramic heater which has fast heat and self temperature saturation characteristics, which is superior in reliability such as heat resistance, and which can be manufactured at low cost is has been desired.

SUMMARY OF THE INVENTION

There is a principal object of the present invention to provide a glow plug for a diesel engine which is highly heat resistant and has superior durability and heating characteristics.

It is another object of the present invention to provide a flow plug for a diesel engine which is easily fabricated resulting in a reduction in manufacturing costs.

It is still an other object of the present invention to provide a glow plug for a diesel engine which can be rapidly heated and its saturation temperature controlled.

In order to achieve the above objects, the present invention is a glow plug for a diesel engine comprising an elongated hollow metal holder supporting a U-shaped ceramic heater so as to project from one end thereof with an external electrical connecting terminal extending into the other end of the holder. The ceramic heater has one leg electrically connected to the external electrical connecting terminal which is supported in an electrically insulated condition with respect to the hollow holder by an insulating member. The ceramic heater includes a resistive ceramic material U-shaped heating portion which projects outwardly from the one end of the holder. A pair of lead portions of a resistive ceramic material is integral with and extends backward from both ends of the U-shaped heating portion. The lead portions are parallel to each other and are spaced apart from each other to define a slit therebetween open to the interior of the hollow holder. The U-shaped heating portion and part of the lead portions project outwardly from the one end of the holder. The U-shaped heating portion has a thickness less than that of the lead portions. One of the lead portions is electrically connected to the interior of the hollow holder and the other lead portion is electrically insulated from the hollow holder and electrically connected to the external connection terminal. An insulating ceramic material is integrally bonded to at least a portion of the pair of lead portions for sealing the slit formed between the lead portions for sealing the interior of the hollow holder against entry of combustion gases.

DESCRIPTION OF THE PREFERRED EMBODIMENTS

Figure 1:
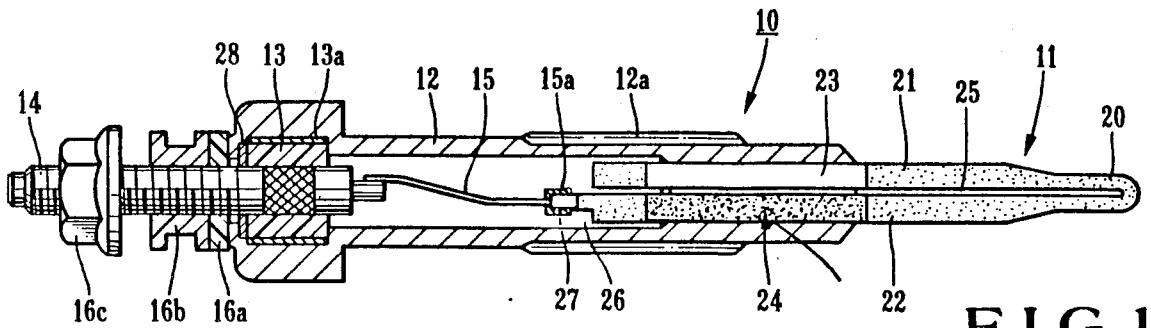
FIG. 1 is a longitudinal sectional side view of an embodiment of a glow plug for a diesel engine according to the present invention.

Preferred embodiments of the present invention will now be described in detail with reference to the accompanying drawings.

FIGS. 1 to 4 show an embodiment of a glow plug for a diesel engine according to the present invention. First, a schematic configuration of a glow plug denoted by reference numeral 10 in FIG. 1 will be described below. The glow plug 10 includes a rod-like ceramic heater 11, the distal end of which serves as a heating portion, and a substantially tubular metal holder 12 for supporting the ceramic heater 11 at its distal end. An external connecting terminal 14 is concentrically engaged with the rear end of the holder 12 through an insulating bush 13 made of a synthetic resin material or the like. The external connecting terminal 14 is connected to lead portions (to be described later) made of a conductive ceramic material constituting the ceramic heater 11 through a metal lead wire 15 such as a flexible wire. Note that in FIG. 1, reference numeral **13*a* denotes a metal pipe integrally fitted around the outer periphery of the insulating bush 13. The metal pipe 13*a* is axially buckled by a high pressure generated by the rear end of the holder 12 caulked during assembly to form the insulating bush 13 integrally with the holder 12 with a predetermined mechanical strength so that a structure is not easily affected by temperature. Reference numerals 16*a*, 16*b*, and 16*c* denote an insulating ring, a fixing nut, and a nut for tightening external leads, respectively, connected to a screw portion at the rear end of the external connection terminal 14. The lead wires or the like from a battery (not shown) are sandwiched between the nuts 16*b* and 16*c* so that the external connection terminal 14 is electrically connected to the battery terminals. The holder 12 is electrically grounded by screwing its screw portion 12*a* into a screw hole at a cylinder head of the engine, and at the same time causes the distal end of the heater 11** to project into a sub combustion chamber or a combustion chamber.

In this embodiment, the external connection terminal 14 is connected to the ceramic heater 11 by the metal lead wire 15 so as to protect the heater 11 from various vibrations or mechanical external forces such as tightening torque. The lead wire 15 is preferably made of a flexible material such as a flexible wire.

Figure 2:
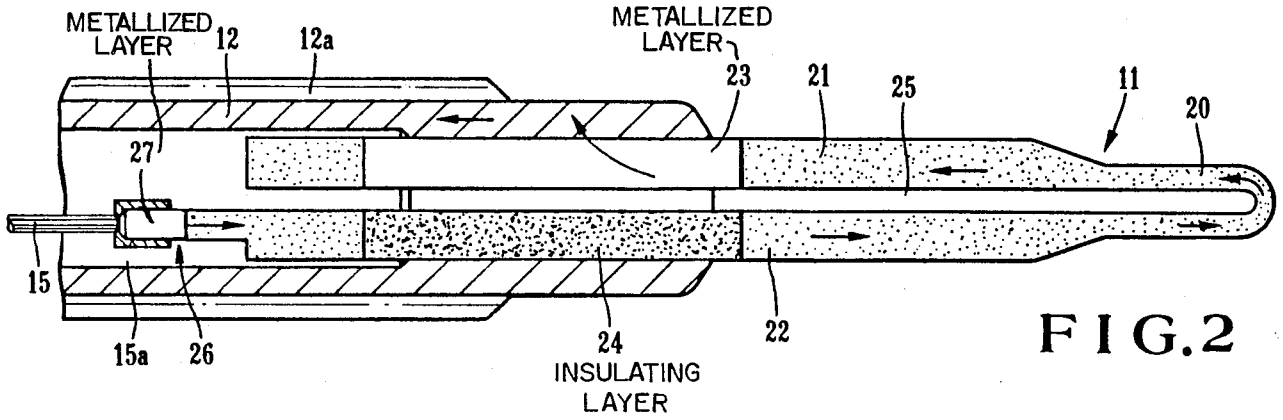
FIG. 2 is an enlarged sectional view of a main part of the embodiment in FIG. 1.
Figure 3:
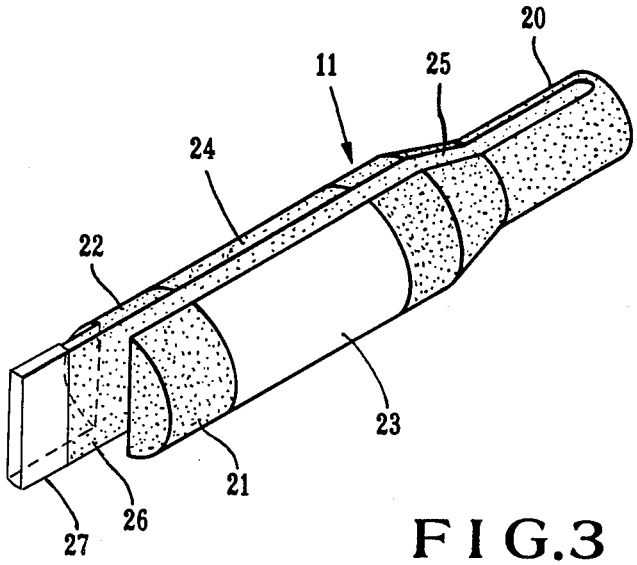
FIG. 3 is a schematic perspective view of a ceramic heater as a main part of the present invention.

According to the present invention, in the glow plug 10 having the above arrangement, the rod-like ceramic heater 11 held at the distal end of the holder 12 is arranged to have a substantially U-shape as a whole by forming a U-shaped heating portion 20 integrally with a pair of lead portions 21 and 22 extending backward from and parallel to the both ends of the U-shaped heating portion 20, as is apparent from FIGS. 2 and 3. In addition, a metallized layer 23 is formed on the outer surface of one lead portion 21, an insulating coating layer 24 is formed on the other lead portion 22 as an insulating layer, and these portions are bonded to the holder 12 to support it.

More specifically, in this embodiment, the heater 11 has the heating portion 20 formed to have a small diameter so that its thickness is smaller than those of the lead portions 21 and 22, and a slit 25 is formed along the longitudinal direction of the heater 11 at the central portion thereof to extend from the heating portion 20 to a portion between the lead portions 21 and 22. In addition, of the lead portions 21 and 22 formed integrally with the heating portion 20 by a resistive ceramic material, the metallized layer 23 (having a nickel plating layer on its surface) is formed on the outer surface of one lead portion 21, and the insulating coating layer 24 (having a nickel plating layer on its surface) is formed on the other lead portion 22. By the layers 23 and 24 and the nickel plating layers formed thereon, the ceramic heater 11 is bonded to the distal end of the holder 12 and is held. In this case, a nickel plating layer is preferably formed also on a bonding surface of the holder 12, but the present invention is not limited thereto.

The one lead portion 21 is electrically grounded to the holder 12 through the metallized layer 23 on its outer surface. The distal end of the metal lead wire 15 drawn from the external connection terminal 14 is electrically plate connected to an electrode end 26 extending backward from the rear end of the other lead portion 22 through the terminal cap **15*a*, so that current flows through the ceramic heater 11 along directions indicated by arrows in FIG. 2**.

The above-mentioned ceramic heater 11 can be easily and properly fabricated by kneading a conductive ceramic material with a thermoplastic resin or the like, injecting the resultant material into a die, and baking it, or by forming a ceramic heater formed to be a rod in advance into a predetermined shape by an electric discharge machine. After this formation, the metallized layer 23 and the insulating coating layer 24 (preferably formed by spraying alumina or the like) are formed on the outer surfaces of the corresponding lead portions 21 and 22, respectively, and nickel plating layers as auxiliary members for connecting the metal holder 12 are formed on their surfaces as post-processing. Note that reference numeral 27 denotes a metallized layer formed on the electrode end 26, and a nickel plating layer is formed on its surface as in the case described above. The lead wire 15 is connected to the nickel layer through the terminal cap **15*a*** to form a heater assembly.

The ceramic heater 11 fabricated as described above is fitted in the holder 12, the outer surfaces of the lead portions 21 and 22 are fixed thereto by brazing or the like through the conductive and insulating layers (23) and (24), and the rear end of the lead wire 15 is connected to the external connecting terminal 14 held by the rear end of the holder 12, thereby assemblying the glow plug 10.

As a conductive ceramic material for forming the ceramic heater 11 having a U-shape as a whole as described above, SIALON or the like which allows selection of insulating properties and conductivity by adjusting the amount of titanium nitride (TiN) added to $\beta$ SIALON or $\alpha$-$\beta$ SIALON ($Si_3N_4$ . . . 88 vol %, $Al_2O_3$ . . . 5 vol %, $Y_2O_3$ . . . 7 vol %) may be preferably used. That is, when TiN is added to the above SIALON in an amount of 20 vol % or more (preferably 24–30 vol % in practice), conductivity by positive resistance temperature characteristics (so-called conductive SIALON) can be obtained, and when more TiN is added, the specific resistance changes continuously. Thus, it is apparent that the content of TiN may be conveniently selected.

However, conductive ceramic materials serving as a resistive body in the ceramic heater 11 are not limited to the SIALONs described above. Ceramic materials which are stable at high temperatures (up to e.g., 1,200° C.) and superior in heat and impact resistances or the like can be used. For example, a SIALON sintered body containing at least one member selected from the group consisting of nonoxide conductive materials such as SiC, and carbide, borides, nitrides, and carbo-nitrides of group 4*a*, 5*a*, and 6*a* elements of the periodic table; and an Al or Al compound as a sintering material.

Conventional glow plugs cannot function as fast heat type glow plugs because they are of an internal heating type obtained by burying a metal heating wire into a sheath or an insulating ceramic material. However, the above structure according to the present invention can eliminate the above problem by exposing the heating portion 20 made of a conductive ceramic material at the outer surface of the heater 11 and can improve its heating characteristics. Especially, since the heating portion 20 is made only of a conductive ceramic material not containing impurities, the glow plug of the present invention has high reliability such as heat resistance irrespective of thermal stress repeatedly applied during operation, is superior in durability, is advantageous in fabrication, and can be mass-produced to reduce manufacturing cost.

Furthermore, according to the ceramic heater 11 of the present invention, since the specific resistance of the conductive SIALON forming the heating portion 20 and the pair of lead portions 21 and 22 can be adjusted by the amount of titanium nitride added thereto, its thickness can be freely set, e.g., a width (cross-sectional area) of the heating portion 20 can be reduced to obtain rapid heating characteristics and to properly control its saturation temperature, thereby realizing a long after glow time. More specifically, such self temperature saturation characteristics are obtained by a relationship between a capacity (cross-sectional area) of the heating portion 20 and that of the lead portions 21 and 22, and these resistive bodies are formed integrally with a conductive ceramic material. Therefore, the ceramic heater 11 according to the present invention is advantageously superior to conventional metal heating wires in terms of fabricability and durability. Especially, the conductive SIALON described above has a large resistance temperature coefficient and thus is advantageous in the self temperature saturation characteristics.

Note that the thickness or the like of each portion of the heater 11 can be freely adjusted during fabrication, thereby freely selecting the resistance value. For example, in this embodiment, when circular cross-sections of the entire heater 11 and the heating portion 20 have diameters 5 mm and 3 mm, respectively, and its length is 50 mm (except 5 mm of the electrode end 26), the length of the heating portion 20 is set to be 10 mm, and the metallized layer 23 and the insulating coating layer 24 are formed to extend by 20 mm from the position at a distance of 25 mm from the distal end. It is experimentally confirmed that the thermal capacity of the heating portion 20 can be made smaller than that of the lead portions 21 and 22 in this manner to obtain a predetermined resistance value, thereby achieving the required self temperature saturation characteristics.

Although a description is omitted in the above embodiment, when the glow plug of the present invention is to be used under strict operating conditions, a protecting film having oxidation resistance at the heating portion 20 may be formed by deposition or the like to obtain higher durability.

Figure 4:
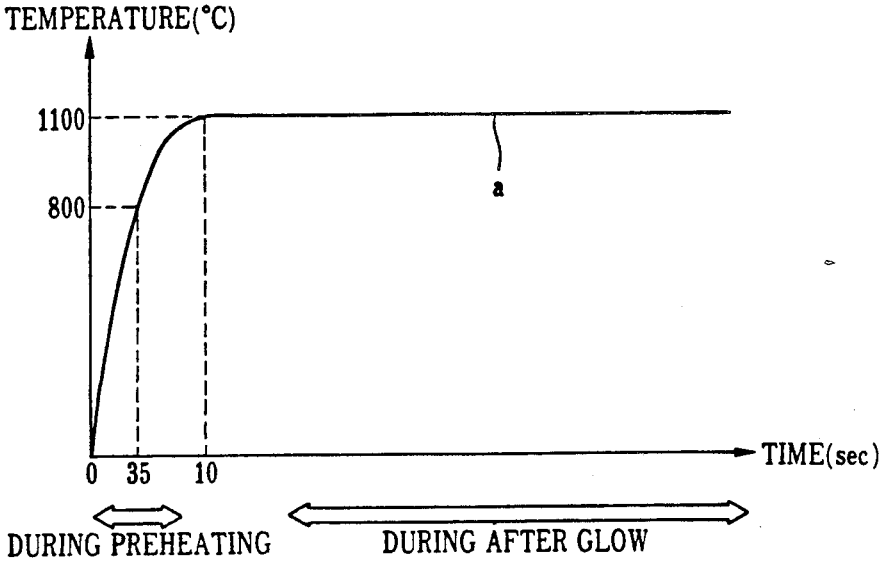
FIG. 4 is a graph of temperature characteristics of the ceramic heater as a main part of the present invention.

When the ceramic heater 11 formed integrally to have a substantially U-shape as a whole by the conductive ceramic material as described above is used, superior characteristics as the glow plug 10 can be achieved as shown in FIG. 4. That is, according to the glow plug 10 of the present invention, it is experimentally confirmed that a saturation temperature can be about 1,100° C. as indicated by curve a in FIG. 4 under conditions that time required to reach 800° C. is 3.5 sec. and an allowable range of the saturation temperature is 1,200° C. or less.

As is apparent from FIGS. 1 to 3, in the glow plug 10 having the above arrangement, the inner space of the holder 12 is communicated with an engine combustion chamber or the like facing the heater 11 by the slit 25 formed along the longitudinal direction of the ceramic heater 11. Thus, combustion pressure produced during explosion in the combustion chamber must be prevented from leaking outside the engine. For this purpose, in this embodiment, a sealing sheet 28 made of asbestos, rubber, or the like is provided to the outer end of the insulating bush 13 formed integrally with the external connecting terminal 14 at an opening of the rear end of the holder 12, thereby mechanically sealing this portion. However, the position of such the sealing portion and the sealing method may have many be varied, e.g., an O-ring or the like may be provided to the inner end of the insulating bush 13 for sealing between the insulating bush 13 and the holder 12.

Figure 5:
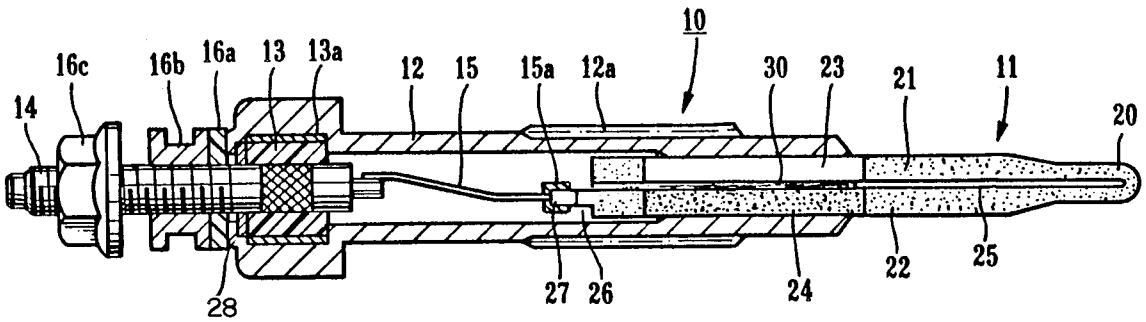
FIGS. 5 and 6 are longitudinal sectional views, of another embodiment of a glow plug for a diesel engine according to the present invention, respectively corresponding to FIGS. 1 and 2.
Figure 6:
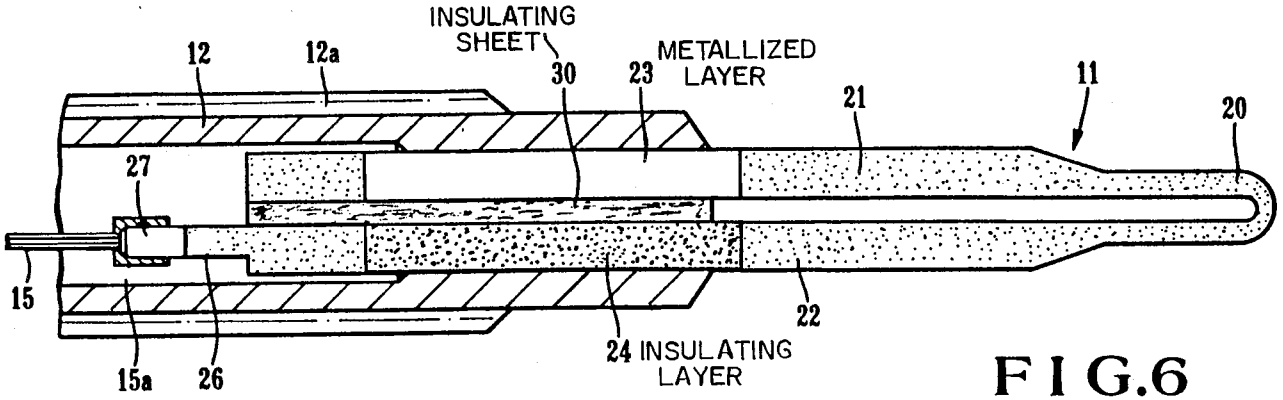

In addition, as a sealing means described above, arrangements shown in FIGS. 5 and 6 can be freely adopted. That is, in the ceramic heater 11, an insulating sheet 30 made of an insulating ceramic material is provided at least to a portion between the lead portions 21 and 22 and corresponding to the distal end of the holder 12. Thus, the sheet 30 is integrally bonded to the lead portions 21 and 22 of a conductive ceramic material, thereby closing the slit 25 with the holder 12 to seal the combustion pressure and prevent leakage thereof. In this arrangement, mechanical strength of the rear end of the ceramic heater 11 held by the holder 12 can be improved, and the sheet 28 for sealing as in the embodiment described above can be omitted, resulting in a great advantage.

As the above insulating ceramic materials, SIALON or the like which allows selection of insulating property and conductivity by adjusting the amount (30% or less or more) of titanium nitride (TiN) may be used in addition to the conductive ceramic material forming the ceramic heater 11. When these materials are selected, the insulating sheet 30 and the resistive body have substantially the same coefficient of thermal expansion, thereby enhancing the bonding strength to obtain reliability such as heat resistance. In order to firmly bond insulating and conductive ceramic materials of the above SIALONs together, an oxide sintering assistant such as $Y_2O_3$ (yttria) is provided between the two materials and sintered to form a diffusion layer at the bonded portion. However, conventional ceramic bonding methods such as a halogenide method, a brazing method, and a solid phase method may be used. In addition, as insulating ceramic materials for forming the insulating sheet 30, materials mainly consisting of SiC, $Si_3N_4$, AlN, and $Al_2O_3$ which are superior in heat resistance or the like and bonding strength with respect to the conductive ceramic material may be used. Further, insulating materials such as glass may be used.

Especially, since the insulating sheet 30 is positioned at the rear end separated from the heating portion 20 of the heater 11, even if reliability of the bonded portion is degraded to some extent, practically no problem is posed.

Figure 7:
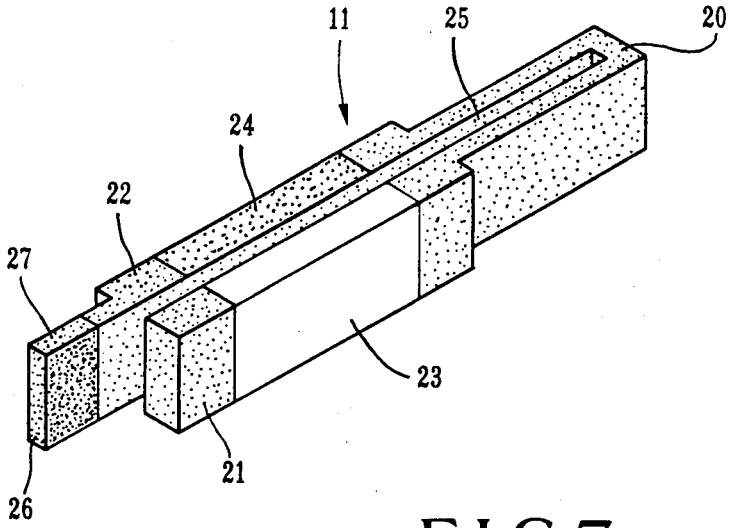
FIG. 7 and FIGS. 8A and 8B are schematic perspective and cross-sectional views, respectively, of modifications of a ceramic heater as a main part of the present invention.
Figure 8A:
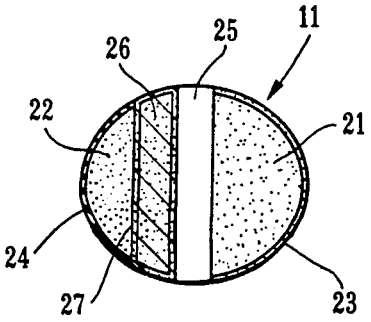
Figure 8B:
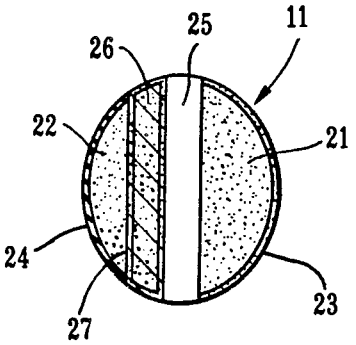

Note that the present invention is not limited to the above embodiments, but various changes and modifications may be made with respect to shapes and structures of the respective parts. For example, the shape of the ceramic heater 11 is not limited to the circular rod shape as in the above embodiment, but may be a square rod shape having a rectangular cross-section as shown in FIG. 7 or an elliptic shape as shown in FIGS. 8A and 8B.

In addition, in the above embodiments, the ceramic heater 11 is held by and bonded to the distal end of the holder 12. For this purpose, the metallized layer 23 is formed on one lead portion 21 and the insulating coating layer 24 is formed on the other lead portion 22 as conductive and insulating layers, respectively, so that the ceramic heater 11 is brazed to the holder 12. However, glass layers may be formed on the outer surfaces of the lead portions 21 and 22 of the ceramic heater 11 to braze it to the holder 12, and many other bonding methods may also be adopted. When the above bonding method using the glass layers and the brazing is adopted, part of the glass layer corresponding to the lead portion to be electrically connected to the holder 12 is partially removed to partially expose the lead portion to assure conductive state through the brazing layer.

As has been described above, according to the present invention, the rod-like ceramic heater is constituted by forming the U-shaped heating portion integrally with the pair of the lead portions extending backward from both the sides of the U-shaped heating portion and parallel to each other using the conductive ceramic material. The outer surface of one lead portion is bonded to the distal end of the holder through the conductive layer, and the other lead portion is bonded thereto through the insulating layer. Regardless of the above simple and inexpensive structure, since the heating portion is made only of the conductive ceramic material without impurities, high reliability such as heat resistance can be obtained against repeatedly applied thermal stress, and good durability and heating characteristics can be achieved. The present invention also facilitates fabrication to reduce manufacturing cost. In addition, by the heating portion of the conductive material exposed at the surface of the heater, the distal end of the heater can be rapidly heated to red hot, thereby achieving the performances as a fast heat type glow plug. The thermal capacity of the distal end heating portion of the conductive ceramic material can be reduced to obtain self temperature saturation characteristics, thereby properly controlling the saturation temperature. As a result, a long after glow time as an exhaust and noise countermeasure of the engine can be obtained to improve the performance of the glow plug.

What is claimed is:

1. A glow plug for a diesel engine, comprising an elongated hollow metallic holder, a ceramic heater having a U-shape as a whole and supported by said hollow holder, so as to project from one end thereof, wherein said ceramic heater is obtained by adding titanium nitrate to SIALON or $\alpha$-$\beta$ SIALON so that its characteristics are varied from insulating to conducting, an external electrical connecting terminal extending into the other end of said holder, means for electrically connecting an end of said ceramic heater to said external connecting terminal, and an insulating member supporting said external connecting terminal in an electrically insulated condition with respect to said hollow holder, wherein said ceramic heater includes a U-shaped heating portion of resistive ceramic material projecting outwardly from said one holder end, and a pair of lead portions of a resistive ceramic material integral with and extending backward from the ends of said U-shaped heating portion and parallel to each other, said lead portions being spaced from each other to define a slit therebetween open to the interior of the hollow holder, said U-shaped heating portion and part of said lead portions projecting outwardly from said one end of said holder, wherein said U-shaped heating portion has a thickness less than that of said lead portions, one lead portion being connected electrically to the interior of said hollow holder, and the other lead portion being electrically insulated from said hollow holder and electrically connected to said external connecting terminal through the interior of said hollow holder via said connecting means, and a sintered ceramic sheet of SIALON which is integrally bonded to at least portion of said pair of lead portions for sealing said slit formed between said lead portions and to seal the interior of the hollow holder against entry of combustion gases.

2. A plug according to claim 1, wherein an electrically conductive layer is formed between said one lead portion and said hollow holder.

3. A plug according to claim 1, wherein an electrically insulating layer is formed between said other lead portion and said hollow holder.

4. A plug according to claim 1, wherein an electrically conductive metallized layer is formed between said one lead portion and said hollow holder, and an electrically insulating layer is formed between said other lead portion and said hollow holder.

5. A plug according to claim 4, wherein said insulating layer consists of a coating layer formed on the outer surface of said other lead portion.

6. A plug according to claim 1, wherein said sintered ceramic sheet is disposed between at least a portion of said lead portions corresponding to said one end of said holder.

* * * * *

UNITED STATES PATENT AND TRADEMARK OFFICE

CERTIFICATE OF CORRECTION

PATENT NO. : 4,874,923

DATED : 10/17/89

INVENTOR(S) : Hatanaka et al.

It is certified that error in the above-identified patent and that said Letters Patent is hereby corrected as shown below:

| | |
|---|---|
| col. 02, line 43 | delete "flow" insert --glow-- |
| col. 06, line 33 | delete "a" insert --a-- |

Signed and Sealed this

Sixth Day of November, 1990

*Attest:*

HARRY F. MANBECK, JR.

*Attesting Officer*

*Commissioner of Patents and Trademarks*